United States Patent [19]

Maluta et al.

[11] 4,321,913

[45] Mar. 30, 1982

[54] ISOLATION INCUBATOR

[75] Inventors: James Maluta, Minona; John H. Wasson, Portage; Robert J. Koch, McFarland, all of Wis.

[73] Assignee: Airco, Inc., Montvale, N.J.

[21] Appl. No.: 110,505

[22] Filed: Jan. 8, 1980

[51] Int. Cl.[3] ..... A61G 11/00

[52] U.S. Cl. ..... 128/1 B; 312/209; 312/236; D24/9

[58] Field of Search ..... 128/1 B, 205.26, 402; 312/209, 236; D24/9

[56] References Cited

U.S. PATENT DOCUMENTS

| | | | |
|---|---|---|---|
| D. 189,805 | 2/1961 | Brush | 128/1 B |
| 3,070,086 | 12/1962 | Smith et al. | 128/1 B |
| 3,158,150 | 11/1964 | Croasdaile | 128/1 B |
| 3,858,570 | 1/1975 | Beld et al. | 128/1 B |

OTHER PUBLICATIONS

Hey et al. "Temperature Control in Incubators", *Lancet* pp. 202–203, Jul. 23, 1966.

*Primary Examiner*—Henry J. Recla

*Attorney, Agent, or Firm*—Roger M. Rathbun; Larry R. Cassett

[57] ABSTRACT

An improved infant incubator is disclosed having a cylindrical shaped transparent hood which provide considerable accessibility to the infant. The cylindrically shaped hood consists of a plurality of sections rotatable about a central axis. The sections may be individually opened to give limited access to the infant or totally rotated to a position beneath the infant support structure such that access may be had from all sides of the incubator without obstructions. Heating of the incubator compartment is achieved by a unique means of circulating heated air through a double wall construction of the hood. The air is heated in a compartment beneath the infant and the warm air enters one of the hood sections and circulates through that section whereupon it is transferred serially to the next section and eventually can be received back into the heater compartment from the hood sections for recirculation. A fan and heater are located in the heater compartment for heating and circulating the air. The double wall hood is readily disassembled and one of the walls removable to facilitate cleaning of all wall surfaces.

21 Claims, 8 Drawing Figures

ISOLATION INCUBATOR

BACKGROUND OF THE INVENTION

This invention relates generally to the field of infant incubators, and more particularly to an improved incubator having a unique hood design affording great accessibility to the infant and incorporating a heating system adapted to maintain the incubator at a predetermined temperature.

There are many designs of infant incubators having a variety of hood constructions and heating means. The objectives in the construction of incubators are basically to provide a temperature and humidity controlled environment to minimize the infant's heat loss and to have good visibility so that hospital personnel can keep a continual visual check on the infant and also provide good access to the infant for changing or performing some function on the infant.

Different heating means include the directing of heated air into the compartment containing the infant to warm its environment; however, such method does have certain deficiencies in that thermal currents or drafts may prevent attaining uniformity of temperature throughout the infant's compartment and also, such systems only provide indirect control of the radiant surfaces surrounding the infant.

Other heating means have included radiant means adapted to direct radiant energy through a hood or within a compartment for heating the infant; however, such means have generally slow response to varying conditions.

One further difficulty with normal heating means involves the problem arising out of an infant's loss of heat by radiant energy. A premature infant has a relatively large surface area that radiates heat, thus losing valuable and needed heat of the infant. Therefore, the heating means must prevent loss of such radiant energy to the utmost extent.

Basically, therefore, qualities desired in an incubator are that access to the infant be provided while allowing a minimum of heat loss from the incubator; a hood should provide good visual contact when in the closed position so that the infant can be observed easily, and complete access to the infant can be gained for carrying out emergency procedures.

SUMMARY OF THE INVENTION

The present invention provides an improved incubator wherein a unique hood design is utilized and wherein the heating means is combined with the hood structure itself.

First, the heating means consists of a fan and heater, generally conventional, and which are located underlying the infant compartment. The fan and heater provide a heated air stream which is uniquely circulated through the hood itself, rather than being introduced directly into the infant compartment. The purpose is to heat the hood so that the loss of radiant energy is significantly controlled. Also, by heating the hood, better surface control is achieved and more control may be maintained despite changes in outside ambient conditions. In effect, the infant compartment is isolated from the outside environmental conditions.

The hood, in order to provide for air flow therethrough, is of a double wall construction, such that the heated air can pass through the space between the double walls and be directed to pass through the hood itself.

The concept is applicable to single or multiple piece hoods, however, in the preferred embodiment two hood sections are employed and, therefore, the heated air is caused to enter one hood, pass entirely therethrough, and then be serially introduced into one end of the other hood section to pass therethrough. As the heated air reaches the end of the second section, it is returned to the heater and blower space below the infant compartment to be reheated and recirculated.

An advantage of the hood and heating system design of the present invention is that excellent visibility is afforded since the double hood may readily be made of transparent materials, such as clear acrylic or polycarbonate and also lacks sharp bends or curves or covered access ports that could distort the view of the infant.

The hood forms a generally cylindrical configuration and, with the preferred embodiment of two sections, the overall hood comprises two slightly overlapping cylindrical segments, each having a different radius but both being rotatable about a common axis.

The common axis itself is mounted on a cantelever frame, such that the rotating sections of hood may be moved into a position substantially underneath the infant compartment to allow almost unlimited accessibility of the infant. As will be evident, two hood sections are designed to be of a radial arc within certain limits for such access. With increasing numbers of hood sections, of course, the individual section arcs may be smaller and thus easier to telescope together underneath the infant compartment, however, the problems of suspension and coupling of the hood sections also increase and, in addition, the resistance to air flow increases, i.e. additional pressure drop is experienced in the transition between hood sections.

Cleanability of the cylindrical hood sections is also readily facilitated by the particular hood construction shown. The inner hood walls, which, along with the outer hood walls, enclose therebetween the path for the heated air, are removable from the hood ends by sliding the same out from their installed position. Removable extrusions hold the hood walls in position and the extrusions also serve as inlets and outlets to introduce, transfer or receive the heated gas to and from the interior of the double wall hood.

Thus, the infant incubator disclosed herein presents unique and advantageous features heretofore not found in the present incubators.

Other features of the incubator will become more apparent in light of the following detailed description of a preferred embodiment thereof and as illustrated in the accompanying drawings.

DESCRIPTION OF PREFERRED EMBODIMENT

Figure 1:
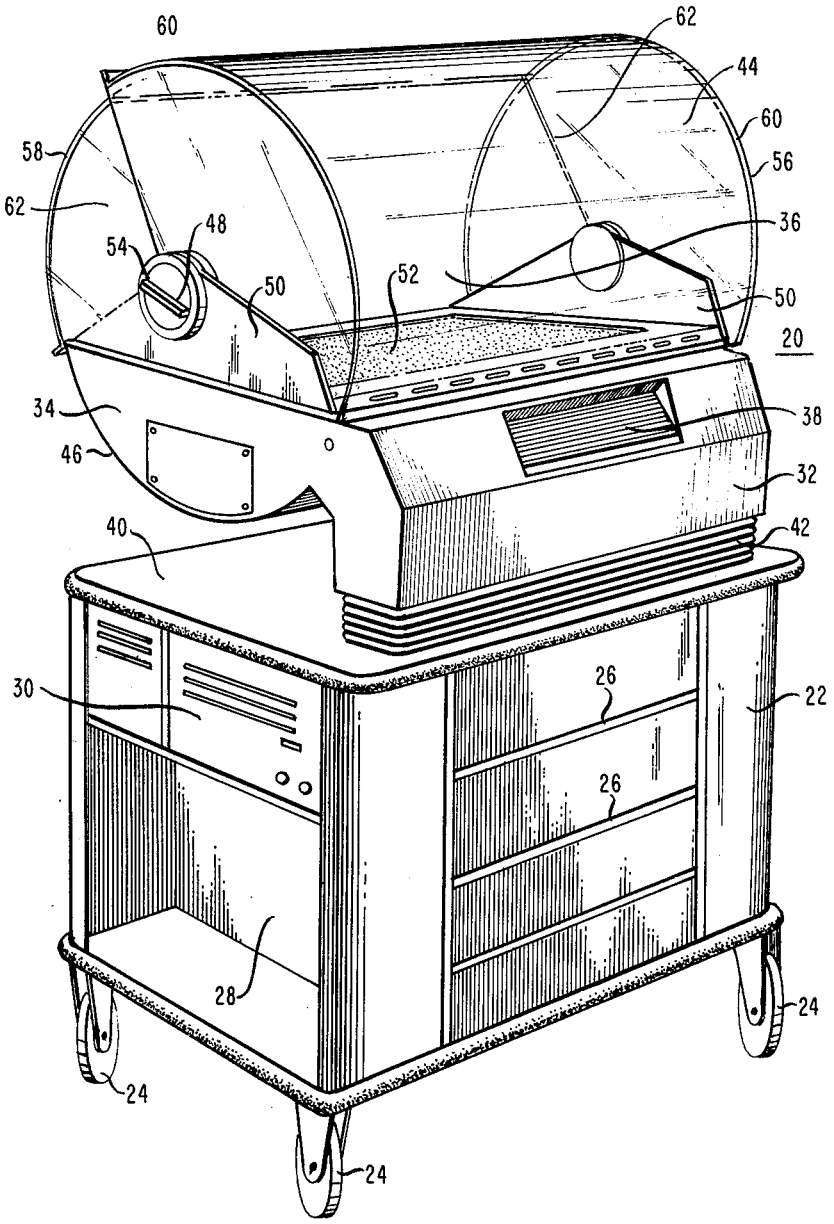
FIG. 1 is an isometric view of the present invention.

Referring now to FIG. 1, there is shown an infant incubator 20 mounted upon a base cabinet 22. The cabinet 22 provides support for incubator 20 at the appropriate height and may include wheels 24 so that the incubator 20 can be easily moved from one position to another. Other usable features are normally provided for the convenience of hospital personnel and could include shelves 26 or storage space 28 for the retaining of articles or containers to be used in connection with care of the infant.

In addition, the cabinet 22 may include space for locating the control electronics 30 or other electrical packages for controlling the heating means and for monitoring certain selected temperatures. Such electronics do not form a part of the present invention but may be any scheme adapted to control the environment surrounding the infant.

The incubator 20 is supported on the cabinet 22 by a base 32, preferably of a rigid structural material, such as aluminum or plastic, including polycarbonate. The base 32 forms a cantelever having extending support 34, the purpose of which will be latter explained.

The extending support 34 underlies the infant compartment 36 within which the infant is placed during use. The base 32 may also contain functioning control and display modules such as at 38 when the operator may selectively set the desired environment temperature for the infant or be able to readout various temperatures or other parameters associated with the environment control. To support the base 32 upon the cabinet 22, there obviously must be extremely firm support members, particularly in view of the cantelever design. Accordingly, such support is located well to the front of the top surface 40 of the cabinet 22. The actual support is not shown, not being a particular feature of this invention, however, the support may be enclosed in accordian section 42 which is flexible to allow for tilting of the incubator base 32 to place the infant in various tilted positions, including Fowler and Trendelenberg positions. In addition, the electrical wiring necessary for functioning of the electronic equipment within the cabinet 22, such as to electrically connect the same to temperature sensors and control devices, readouts and the like may pass through the accordian section 42 up to within the incubator itself.

As may be seen in FIG. 1, a cylindrical hood 44 overlies the extending support 34 and thereby encloses the infant compartment 36. The hood 44 is of a transparent material and surrounds, radially in excess of 180°, the infant compartment 36, and has the same axis as the cylindrically shaped circular bottom 46 formed in the extending support 34.

The axis of the circular hood 44 is at 48 and the hood 44 is rotatable about that axis as will be later explained. The hood 44 is, however, supported along that axis through the use of upwardly directed flanges 50 that raise the axis above the patient supporting plate 52. A tensioning means 54 supports the hood 44 with respect to flanges 50 and provides a predetermined tension such that the hood 44 may be rotated a selected amount and remain in that position.

In the further description of this invention, the preferred embodiment will be set forth wherein the hood 44 comprises two separate sections, a front hood section 56 and a rear hood section 58, each having end walls 60 and 62, respectively; however, it will be appreciated that the hood 44 may be of a further plurality of individual cooperating sections or may even be a single section and still be within the confines of the present invention.

In the two section embodiment, however, it may be seen that the space beneath the circular bottom 46 of the extending support 34 includes approximately 120 radial degrees of a circle about an axis approximately at 48. On that same axis, but, for reasons that will be later explained, of slightly differing radii, are the front hood section 56 of approximately 132 radial degrees and the rear hood section 58 of approximately 98 radial degrees. The significance of the radial degrees of these components will become obvious when the means of entirely opening the hood 44 is described. As may be seen, one reason in choosing the angular degree is to provide an offset at the top of the hood free from obstructions such that X-ray equipment can be placed directly above the infant, outside the hood, and be utilized free from obstructions that could create distortion.

Figure 2:
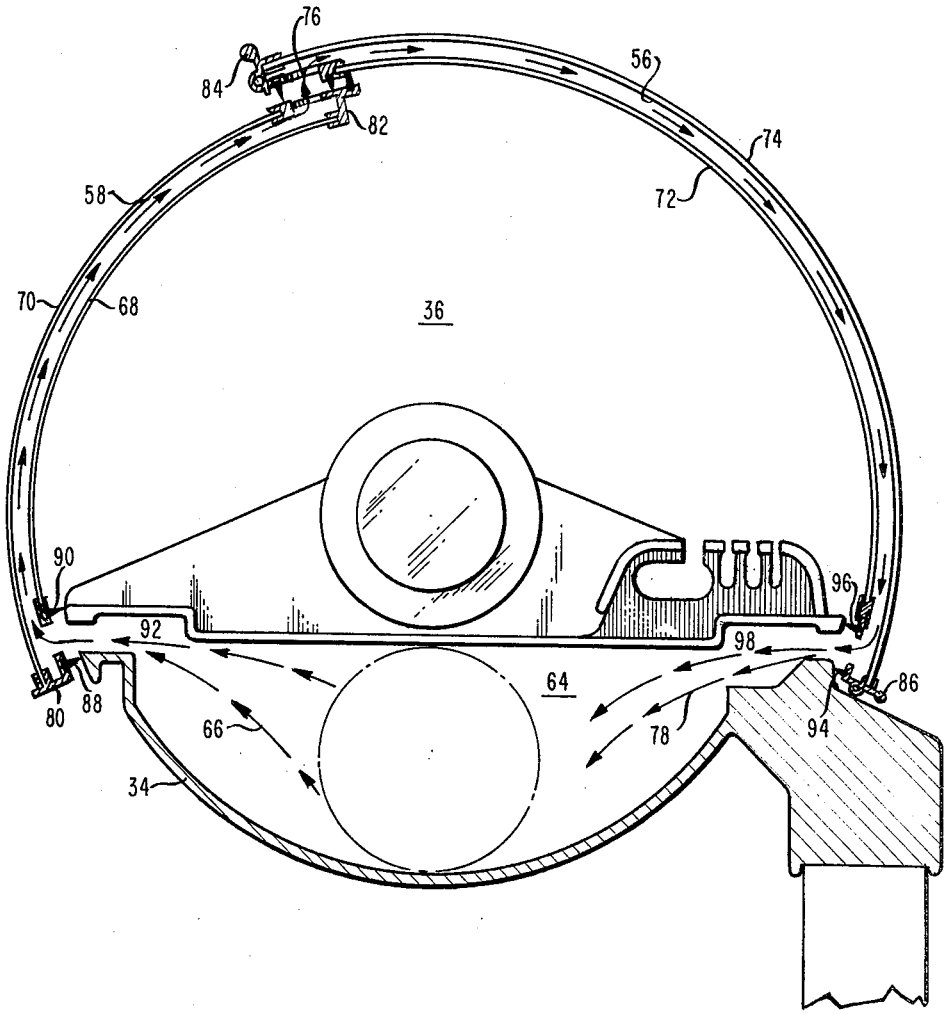
FIG. 2 is a side cross-sectional view of the present invention showing the flow path of the heated air.

Turning now to FIG. 2, there is shown a cross-sectional view wherein the flow path of the heated air is used to warm the infant compartment 36.

A heater compartment 64 underlies the infant compartment 36 and contains the means to heat the air. The actual means to provide such heat may comprise a conventional heater and blower, not shown, and which heats air and forces the heated air in the direction of arrows 66 into the double walled hood sections 58 and 56, as will be explained.

The rear hood section 58 is comprised of an inner wall 68 and an outer wall 70, both of which are cylindrical sections having a curvature of differing radii but with the same axis. The front hood section 56 is similarly constructed and has an inner wall 72 and an outer wall 74.

Following the flow of heated air beginning with arrows 66, therefore, it can be seen that the air enters the rear hood section 58 and passes within hood section 58, between its inner and outer walls 68 and 70. The heated air then crosses over from the rear hood section 68 to the front hood section 56 as shown by arrow 76 and thereupon continues between the inner and outer walls 72 and 74 of front hood section 56 until, at the arrows 78, the heated air, having given up a portion of its heat in warming the hood sections 58 and 56, reenters the heater compartment 64 to be reheated and recirculated.

At each edge of the rotating hood sections 58 and 56, there are specially formed extrusions 80, 82, 84 and 86 which serve to hold the individual walls 68, 70, 72 and 74 in place as will be later explained, and also allow the circulating air to enter rear hood section 58 and exit front hood section 56. In order to prevent leakage of circulating air at any point where sliding surfaces of the hood sections 58 and 56 could permit such leakage, a sealing means is provided so as to form a seal about the extrusions.

As may be thus seen in FIG. 2 where the hood fully encloses the infant compartment 36, the rear hood section 58 has a pair of wipers 88,90 at its lowermost edge, one of which seals against the lower part of the cantelever extending support 34 and the other of which is slightly above the first seal and seals against the upper portion of the extending support 34. The wipers 88,90 are formed of a flexible material that extends outwardly from extrusion 80 and seals against the desired surfaces. The combined seals thereby isolate the outlet 92 of the heater compartment 64 to prevent leakage of heated air passing from the heater compartment 64 into the extrusion 80 at the lower edge of the rear hood section 58 to the outside environment, or into the infant compartment 36.

In the same manner, extrusion 86 is located at the lower most edge of front hood section 56 and have lower and upper wipers 94 and 96, respectively, which seals extrusion 86 to the inlet 98 of the heater coompartment 64 when circulating air is returned from the front hood section 56 to heater compartment 64.

Figure 3:
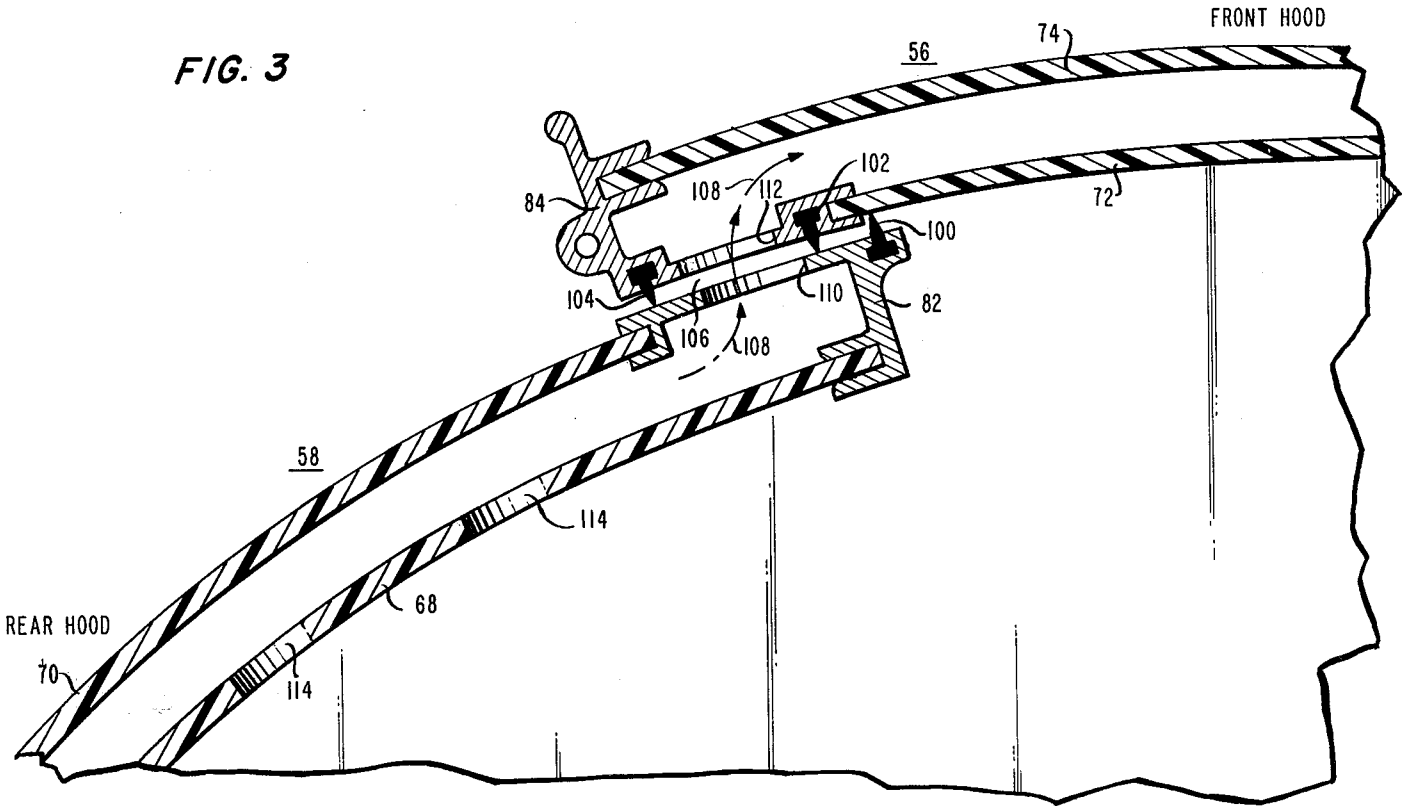
FIG. 3 is an enlarged side cross-sectional view of the portions of the hood used in the invention.

At the upper ends of the front hood section 56 and the rear hood section 58, the hood sections overlap and an enlarged cross-section of the overlapping section can be seen in FIG. 3. A single wiper 100 depends outwardly from extrusion 82 and, when the hood sections 56,58 are in the closed position, the wiper 100 seals extrusion 82 against the inner wall 72 of the front hood section 56.

A pair of wipers 102,104 depend outwardly from the extrusion 84 at the upper edge of front hood section 56 and seal against extrusion 82, thereby forming a sealed chamber 106 between the extrusions 82 and 84.

The flow of heated air from rear hood section 58 to front hood section 56 thus can be seen by reference to the arrows 108 where the air flows from the internal space in the rear hood section 58, that is, from the space between inner wall 68 and outer wall 70, through an opening 110 in extrusion 82, passes through sealed chamber 106 and thereupon enters opening 112 in extrusion 84. Leakage is again prevented by the wipers 104 and 102 which form the sealed chamber 106 through which the heated air passes in moving from rear hood section 58 to the front hood section 56.

As may also be seen in detail in FIG. 3, a plurality of openings 114 are formed in the inner wall 68 of rear hood section 58. When the hood sections 58 and 56 are in the fully closed position, as shown in FIGS. 1, 2 and 3, some of the heated air passes into the infant compartment 36 as the air passes serially through the hood sections and is due to a certain amount of backpressure in the flow path of the air. It is desirable to position openings 114 where backpressure is positive so that flow of air is into infant compartment rather than out of it. The actual amount of such air passing through openings 114 is, however, relatively small and may represent 5 to 10 percent of the total flow of circulated air.

Figure 4:
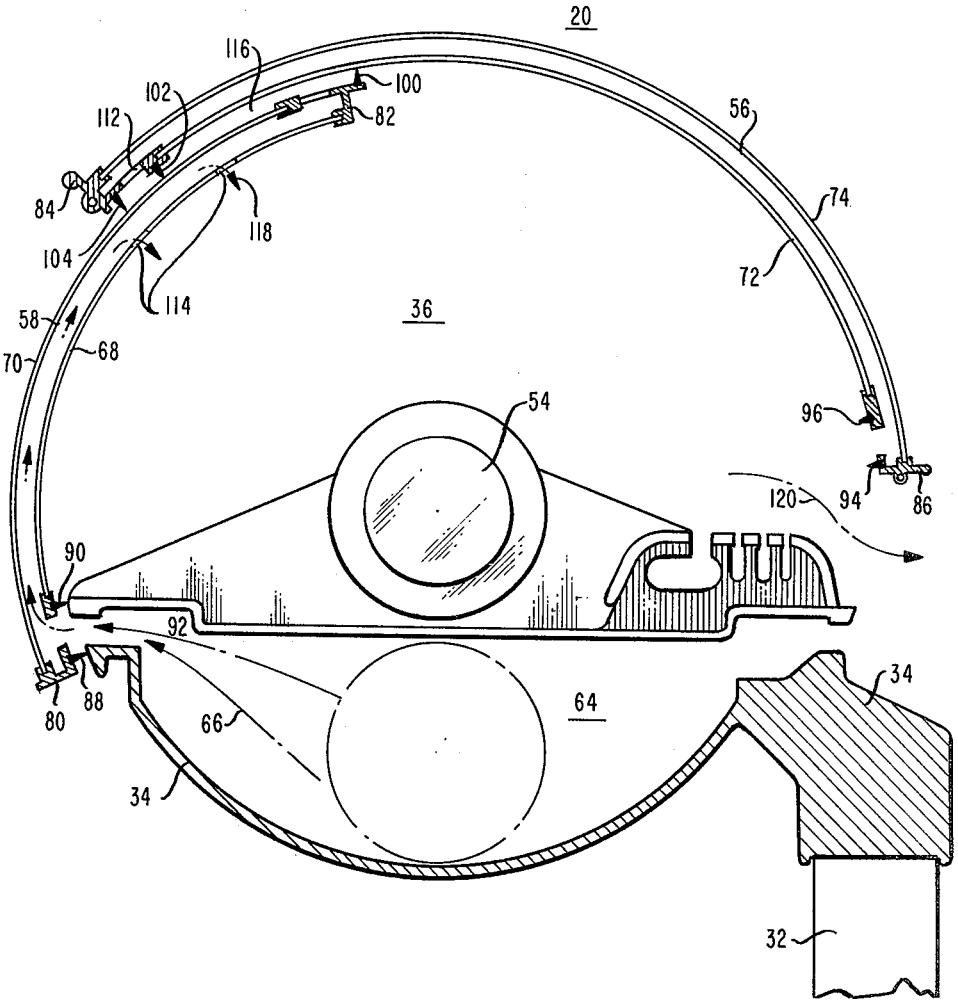
FIG. 4 is a side cross-sectional view of the present invention showing one of the hood sections partially opened.

Turning now to FIG. 4, the incubator 20 is shown having the front hood section 56 opened to a sufficient degree to allow hospital personnel to reach into the infant compartment 36 to carry out some procedure on the infant.

As may be seen in FIG. 4, the flow of heated air from the heater compartment 64 still proceeds through the outlet 92 and into the rear hood section 58. As the heated air reaches the forward end of rear hood section 58, however, it is prevented from entering the front hood section 56 since the opening 112 of extrusion 84 is displaced and wiper 102 prevents air from entering opening 112. Also, wiper 100 seals the upper end of rear hood section 58 against the inner wall 72 of the front hood section 56, thus the heated air is trapped in the space 116 between the two hood sections 58 and 56.

In such position the heated air leaves the rear hood section 58 through openings 114, as shown by arrows 118, and into the infant compartment 36, thus providing warm air directly to the infant when the front hood section 56 is partially opened. The warm air leaves the infant compartment 36 by passing below the partially opened front hood section 56, as shown by arrow 120.

In this manner, when the front hood section 56 is opened in the manner shown by hospital personnel, warm air is directed into the infant compartment 36 to provide heat to the infant while blocking, to some extent, the admission of ambient air into the infant compartment 36, thereby protecting the infant's environment. Obviously, the front hood section 56 may be opened to varying extents and in each selected position will be held in that position by the tensioning means 54. Thus, in the uppermost position of front hood section 56, there is considerable access to the infant and consequent high loss of heated air, while the front hood section 56 may also only be opened a relatively minor radial amount, sufficient for hospital personnel to place their hands in the infant compartment 36 for attending to the infant, with consequential little loss of heating ability.

As a practical matter, the design can be made to accommodate a constant opening of about 4 inches and the flow of heated air sufficient to continually maintain the infant compartment at the desired conditions.

Figure 5:
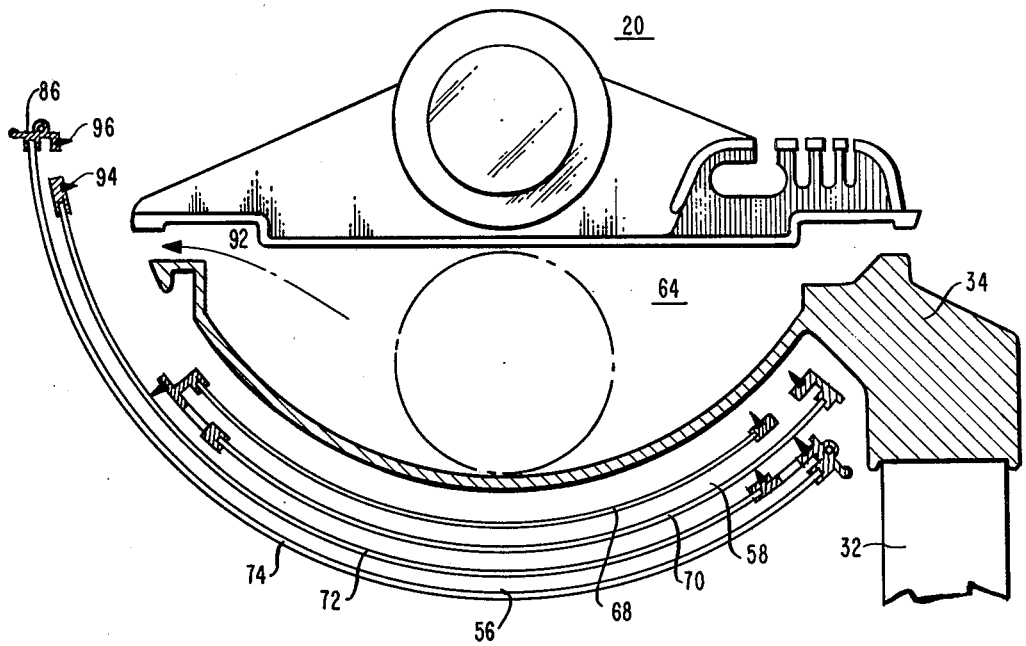
FIG. 5 is a side, isometric view showing the incubator hood in a fully opened position.

In FIG. 5, the incubator 20 is shown having the maximum access, that is when both the front hood section 56 and the rear hood section 58 are fully rotated to positions underlying the cantelever extending support 34. In this position, therefore, the infant is fully exposed to the outside environment and other suitable means of heating may be provided, such as radiant heaters if it is necessary to elevate the infant's temperature or retain it at the desired temperature.

In order to be able to move the rotating hood sections 56 and 58 to a position completely underlying cantelever extending support 34, and to achieve optimum maneuverability and access to the infant, the hood sections are constructed to be within specific radial dimensions. Also, the placement of the patient supporting plate 52 (FIG. 1), with respect to the hood axis, can be optimized for such accessibility. In the preferred form of the invention, a two-section hood is used wherein the patient supporting plate 52 is located in a horizontal position below the axis of the rotating hood sections. The front hood section 56 forms an arc of approximately 132°, while the rear hood section 58 forms an arc of approximately 98°. Since each hood section rotates independently, the front hood section 56 may be opened to any desired degree, or the rear hood section 58 may be itself opened for access to the opposite side of the infant.

In similar manner, both hood sections may be partially opened for simultaneous access to both sides of the infant, or, as shown in FIG. 5, complete access may be gained to the infant on all sides with only a minimum (a few inches) of the front hood section 56 extending above the surface of the patient supporting plate 52 at the rear of the incubator 20. Any time the rear hood section 58 is opened, the flow of heated air terminates and, therefore, the rear hood section 58 should be opened for only short periods of time.

In the preferred embodiment described, the maximum access from the front of the incubator 20 is about 90°. The maximum access from the rear of the incubator 20 is about 90°, or the maximum simultaneous access, of front and rear, is about 45°.

One necessary feature in the use of double hood construction is the requirement that the passage between the inner and outer walls through which the circulating warm air passes, be readily accessible for cleaning.

In the present invention, the inner walls 68 and 72 are completely removable, such that all surfaces of inner walls 68 and 72, as well as outer walls 70 and 74 are easily cleanable.

Figure 8:
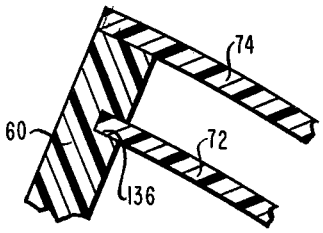
FIG. 8 is an end view of the hood section of FIG. 7.

The removability of inner walls 68 and 72 is illustrated by reference to FIGS. 6, 7 and 8. As a reference, the removability of the inner wall 72 of the front hood section 56 will be shown, however, it will be noted that the same procedure is used in removing the inner wall 68 of rear hood section 58.

Figure 6:
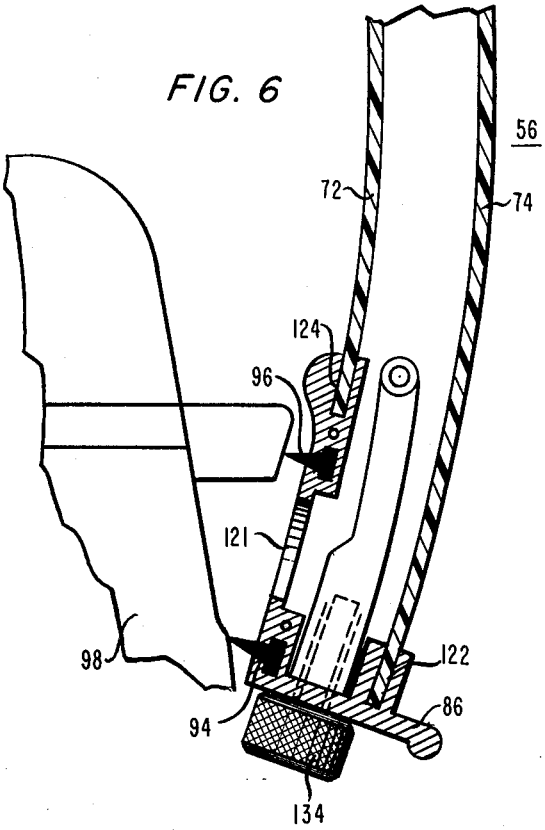
FIG. 6 is an enlarged side cross-sectional view of the hood section.

In FIG. 6, there is shown an enlarged side cross-sectional view of the front hood section 56 having inner wall 72 and outer wall 74, both of which interfit with extrusion 86. As previously explained, the extrusion 86 also holds wipers 94 and 96 which seal the extrusion 86 against the inlet 98 to heater compartment 64 when the front hood section 56 is in the fully closed position. The extrusion 86 runs the full length of the front edge of front hood section 56 and along the length of extrusion 86 is an opening 121 (shown as a plurality of openings) through which the air enters inlet 98. As shown, extrusion 86 has an outer recess 122 with appropriate flanges to receive the front edge of outer wall 74 and an inner recess 124 which correspondingly receives the front edge of inner wall 72.

Figure 7:
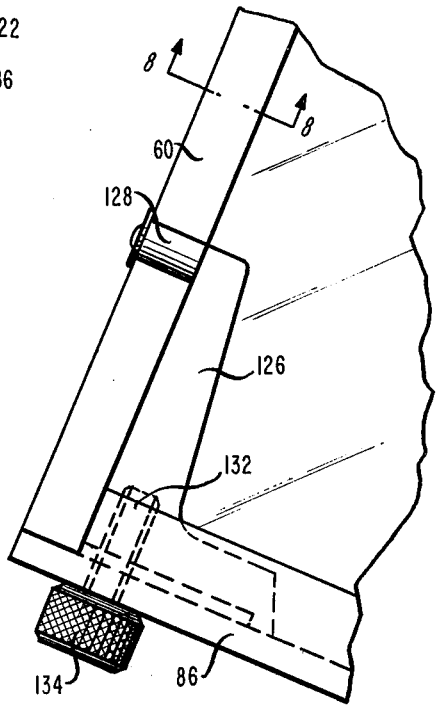
FIG. 7 is an enlarged front view of the hood section of FIG. 6.

The extrusion 86 itself is held in position but is readily removable from such position holding walls 72 and 74 by means of an extrusion retainer 126 (FIG. 7). The retainer 126 has an outwardly directed post 128 that fits into an opening in the hood end wall 60. At the other end of retainer 126, there is a threaded hole 132 into which a threaded knob 134 is screwed and which holds extrusion 86 against the extrusion retainer 126, thereby affixing the extrusion 86 to the end wall 60 of the front hood section 56.

Accordingly, to remove the extrusion 86, one merely loosens the threaded knob 134 and laterally moves extrusion retainer 126 to disengage post 128 from hood end wall 60, it being noted that each hood and extrusion has two such retainers, and the extrusion 86 may be removed. As may be seen in the cross-sectional view of FIG. 8, the inner wall 72 is held in its position by being restrained in a recess 136 along the inner surface of end wall 60. The inner wall 72 is actually sufficiently flexible and so shaped that it is slid within recess 136 for assembly. Accordingly, for removal thereof, after removal of extrusion 86, the entire inner wall 72 can be slid from the end wall 60 (and, of course, also the opposite end wall) and thereby be completely removed from front hood section 56. When removed, all surfaces of the inner wall 72 and the outer wall 74 are fully accessible for cleaning.

It will be understood that the scope of the method and product of this invention is not limited to the particular steps or materials disclosed herein, by way of example, but only by the scope of the appended claims.

We claim:

1. An infant incubator for providing a controlled environment for an infant, said incubator comprising a base section, an infant support adapted to underlie an infant, and a hood mounted to said base section and adapted to cover said infant support to enclose therebetween an infant compartment, said hood being cylindrical and comprising a plurality of sections concentrically and rotatably mounted about a common axis to said base section, said sections of said hood being rotatable to an open position providing access to said incubator compartment and to a closed position, each of said sections comprising an interior wall and an exterior wall in close proximity thereto, and having side walls, said interior and exterior walls of each section defining therebetween a passageway throughout said respective section of said hood, each said section having an inlet means and an outlet means communicating with said respective passageway, said inlet and outlet means of each said section providing a continuous flow path through said sections of said hood when said hood is in the closed position and heating means mounted in said base and communicating with said inlet means and outlet means of said respective sections of said hood adjacent said base when in said closed position for circulating heated air between said heating means and said continuous flow path through said hood whereby heat from said circulated air is transferred to said hood.

2. An incubator as described in claim 1 wherein one of said interior or exterior walls is slidingly engaged with said end walls and is removable therefrom.

3. An incubator as described in claim 1 including tension means adapted to retain each of said plurality of hood sections at any selected position.

4. An incubator as described in claim 1 further including duct means for conducting air between said heating means and said inlet and outlet means adjacent said base when said hood is in its closed position, said duct means channeling such air from said outlet means to said heating means to heat the air for providing the heated air to said inlet means.

5. An incubator as described in claim 1 wherein said hood comprises two sections, said sections having slightly differing radii whereby said two sections may be telescoped together.

6. An incubator as described in claim 5 wherein one of said sections forms an arc of about 132 degrees and the other section forms an arc of about 98 degrees.

7. An incubator for providing a controlled environment for an infant, said incubator having a cantelever base, said cantelever base comprising an upstanding support and an infant support depending outwardly from said upstanding support, a cylindrical hood covering said infant support and forming with said infant support an infant compartment, means supporting said cylindrical hood at its central axis, said hood support means adapted to allow said hood to freely rotate about said axis such that said hood is rotatable to a position substantially beneath said outwardly depending infant support to allow substantial access to said infant compartment.

8. An incubator as defined in claim 7 wherein said hood comprises a plurality of sections, at least one of which is movable to a position substantially beneath said infant support.

9. An incubator as defined in claim 8 wherein each of said plurality of hood sections is movable to a position substantially beneath said infant support.

10. An incubator as defined in claim 9 wherein said plurality of hood section comprises two sections, one of such sections forming an arc of about 132 degrees and the other of said sections forming an arc of about 98 degrees.

11. An incubator as defined in claim 9 wherein each of said sections rotates about a common axis, said axis being located about said infant support.

12. An infant incubator adapted to contain an infant in a controlled environment within an infant compartment, said incubator comprising an L-shaped cantelever base, said cantelever base comprising an upstanding support and an infant support depending outwardly from said upstanding support, a transparent hood mounted to said base and covering said infant support to enclose the infant compartment, said hood comprising a cylindrical segment and being movable about an axis for enclosing or opening access to the infant compartment, said segment being movable in opening said access to a position at least partially beneath said infant support, said hood having side walls, and having an interior wall and an exterior wall forming therebetween a passageway for gas substantially throughout said hood, an inlet means formed at one lower end of said cylindrical segment and an outlet means at the other lower end of said cylindrical segment, air heating means for providing heated air to said inlet means whereby said heated air passes substantially through said hood within said passageway and leaves said hood through said outlet means, thereby heating said hood.

13. An infant incubator as defined in claim 12 wherein said heating means is located in said cantelever base.

14. An infant incubator as defined in claim 12 wherein said hood is transparent and comprises a plurality of sections, at least one of which is rotatable about its axis, and a gas path is provided for warm air to pass serially through said plurality of sections.

15. An infant incubator as defined in claim 12 wherein said hood comprises two sections comprising a total cylindrical arc of about 230 degrees, both of said sections being movable about a common axis, one of said sections having said inlet means for receiving air from said heating means and further having an intermediate outlet in gas communication with an intermediate inlet of said other section, said other section having said outlet means.

16. An infant incubator as defined in claim 15 wherein said outlet means is in gas communication with said heater means whereby air is returned to said heater means subsequent to passage through said hood.

17. An infant incubator as defined in claim 15 wherein said one of said sections further has an opening in said internal wall to allow a portion of warm air passing through said passageway to enter said infant compartment.

18. An infant incubator as defined in claim 17 wherein means are provided to prevent communication between said sections when said other section is moved from a position completely closing said infant compartment whereby at least substantially all of the warm air passes into said infant compartment through said opening.

19. An infant incubator as defined in claim 15 wherein the interior walls of each of said sections are slidably affixed to said end walls, whereby said interior walls are removable from said hood.

20. An infant incubator as defined in claim 15 wherein said hood sections are of different radii and are both movable to a position substantially beneath said infant support to provide full access to said infant compartment.

21. An infant incubator as defined in claim 20 further including tension means to hold each of said hood sections in any one of a plurality of positions.

* * * * *